US005160302A

United States Patent [19]

Li

[11] Patent Number: 5,160,302

[45] Date of Patent: Nov. 3, 1992

[54] EXERCISING AND PHYSICAL CONDITIONING APPARATUS

[76] Inventor: Hsung-cheng Li, 17 Lane 18, Chunghsing N. Street, Sanchung City, Taipei Hsien, Taiwan

[21] Appl. No.: 654,353

[22] Filed: Feb. 11, 1991

[51] Int. Cl.[5] ..... A63B 22/04

[52] U.S. Cl. ..... 482/51; 482/53

[58] Field of Search ..... 272/69, 70, 70.2, 116, 272/130, 173; 128/25 R

[56] References Cited

U.S. PATENT DOCUMENTS

| | | | |
|---|---|---|---|
| 3,970,302 | 7/1976 | McFee | 272/70 |
| 4,555,108 | 11/1985 | Monteiro | 272/130 |
| 4,687,195 | 8/1987 | Potts | 272/70 |
| 4,838,543 | 6/1989 | Armstrong | 272/70 |
| 4,934,688 | 6/1990 | Lo | 272/70 |
| 4,934,690 | 6/1990 | Bull | 272/70 |
| 4,940,233 | 7/1990 | Bull | 272/70 |
| 4,989,857 | 2/1991 | Kov | 272/70 |
| 5,016,872 | 5/1991 | Lee | 272/70 |

*Primary Examiner*—Richard J. Apley
*Assistant Examiner*—Jerome Donnelly

[57] ABSTRACT

An exercising machine which consists essentially of a main frame, a handrail, a tread roller and two fluid pressure cylinders, wherein the main frame is designed to support and install all members concerned, the handrail may be fixed or adjustable in favor of being adjusted up and down so as to fit the height of different exercisers. The tread roller is a cylindrical roller body whereon two-pair of steps are positioned in an upward and downward position in the center of a roller body, separated from each other by an angle of 90°. The roller body is pivotally installed, roughly, in the center of the main frame capable of rotation clockwise and counterclockwise.

One crank coupling each is fixed on the two ends of roller body; the two fluid pressure cylinders are equipped with a bilateral resistance action and respectively and pivotally installed in a position nearby the front, on the side of the main frame. The end of thrust rod on these cylinders is respectively connected to and pivotally installed on the crank coupling, on the two sides of tread roller. The positions of pivotal installation have to be separated from each other with a 90° to 135° angle.

4 Claims, 3 Drawing Sheets

3
12
1
131
13
141
133
15
11
132b
14b
14a 22
2
24a
24b
21
23a
23b

EXERCISING AND PHYSICAL CONDITIONING APPARATUS

BACKGROUND OF THE INVENTION

Presently exercising machines (2) which do not require a driving force to achieve a healthful purpose are available as shown in FIG. 3. These machines usually consist of a machine frame 21, a handle 22, two steps 23*a*, 23*b*, two fluid pressure cylinders 23*a*, 24*b*, and a traction rope (25). The exerciser's feet stand directly on the two steps 23*a*, 23*b*, one step being higher than the other, with his or her hands holding the handle 22, keeping a standing posture and with his or her feet the user repeatively depresses the steps 23*a*, 23*b* in a manner of treading for healthful exercise so as to achieve the healthful purpose. When using a conventional exercising machine, (as disclosed in FIG. 3). For healthful exercise, healthful actions are limited to direct standing and pure treading. These actions are instrumental to the exercise of the exerciser's legs without obvious effect on his or her hips, waist, arms, wrist and other parts of the body. The exercise manner of standing and treading tends to be monotonous and un-interesting, usually the user tires of using these types of conventional exercising machines after exercising a few times, therefore, it is meaningless to buy conventional machines for reducing weight and preventing one's body from becoming too fat. The present inventor and applicant, in view of the above, has developed an exercising machine in accordance with the present invention.

SUMMARY OF THE INVENTION

The present invention is related to an improved exercising machine for healthful exercise which does not require a driving force to achieve the healthful purpose, and particularly to an improved exercising machine for healthful exercise with the exerciser's two feet forcefully treading and turning a roller. This machine consist essentially of a main frame, a handrail, a tread roller, and two fluid pressure cylinder's.

The object of the present invention is to offer an improved exercising machine to achieve the healthful purpose for the whole body through an action of exercise which includes: to forcefully and repeatedly tread the tread roller and while holding a handrail in keeping with the strength of the exerciser's waist, back and abdominal muscle.

CROSS-REFERENCE NUMBERS

| | |
|---|---|
| 1 | an exercising machine of the present invention |
| 2 | exercising machine |
| 3 | exerciser |
| 11 | main frame |
| 12 | handrail |
| 13 | tread roller |
| 14a, 14b | fluid pressure cylinders |
| 130 | roller body |
| 131 | step |
| 132a, 132b | crank coupling |
| 15 | step |
| 16 | protective plate |

-continued

| | |
|---|---|
| 21 | machine frame |
| 22 | handle |
| 23a, 23b | tread plate |
| 24a, 24b | fluid pressure cylinders |
| 25 | traction rope |
| 133 | slot |
| 141 | thrust rod (shaft) |

DESCRIPTION OF THE PREFERRED EMBODIMENT

Figure 1:
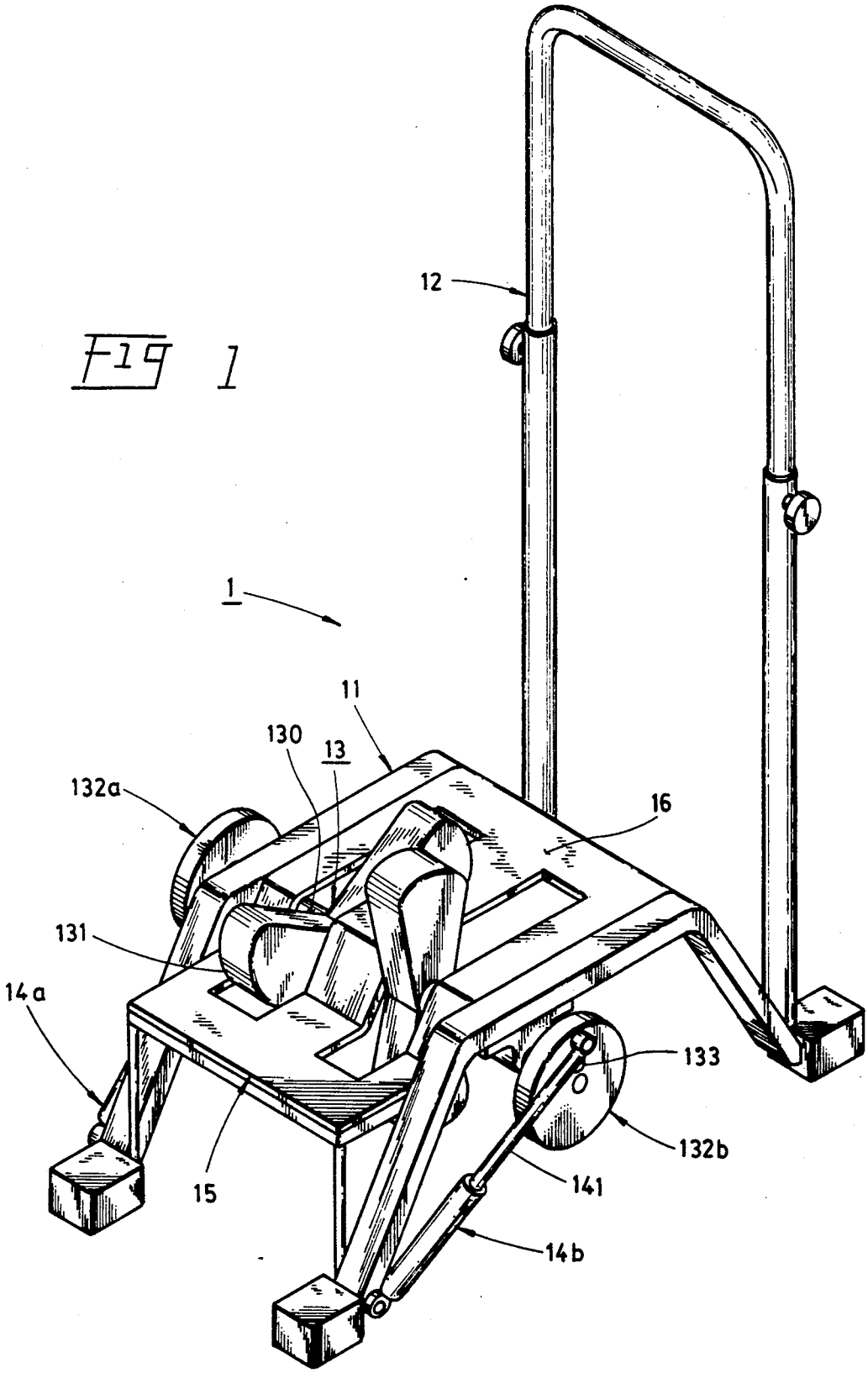
FIG. 1 is a elevational view of the present invention.

As shown in FIG. 1, an exercising machine of the present invention consists essentially of a main frame 11, a handrail 12, a tread roller 13 and two fluid pressure cylinders 14*a*, 14*b*, wherein the main frame 11 is roughly a reverse U-shaped frame welded together using a connecting rod for supporting all the members concerned. The handrail 12 may be fixed or adjustable up-and-down so as to fit exercisers with different heights; the tread roller 13 is a cylindrical roller body 130 whereon two-pair of steps 131 are position in an upward and downward position in the center of roller body 130 and separated from each other with a 90° angle. The roller body 130 is pivotally installed roughly in the center of main frame 11 and capable of rotation clockwise and counterclockwise, one crank coupling 132, 132*b* is fixed on the two ends of roller body 130; and the two fluid pressure cylinders 14*a*, 14*b* are equipped with a bilateral resistance action and respectively and pivotally connected to the front on the two sides of main frame 11. The end of thrust rod (shaft) 141 on these cylinders 14*a*, 14*b* is respectively connected to and pivotally installed on the crank coupling 132*a*, 132*b* on the two sides of tread roller 13, the positions of pivotal installation must be separated from each other with a 90° to 135° angle.

As shown in FIG. 1, one slot 133 each is provided to the crank coupling 133*a*, 133*b*, so the position of "center distance" for pivotally installing the terminal of thrust rod (shaft) 141 of fluid pressure cylinder 14*a*, 14*b* can be adjusted in order to regulate the force applied to the two fixed steps 131 on the tread roller body 130 by the exerciser of healthful exercise who treads on said body 130. In addition, a step 15 on the front side of main frame is designed to be "temporarily treaded" by said exerciser and to prevent the exerciser from falling. Meantime, a protective plate 16 on the rear side of the main frame 11 is designed to enhance the safety of using the present exercising machine.

Figure 2:
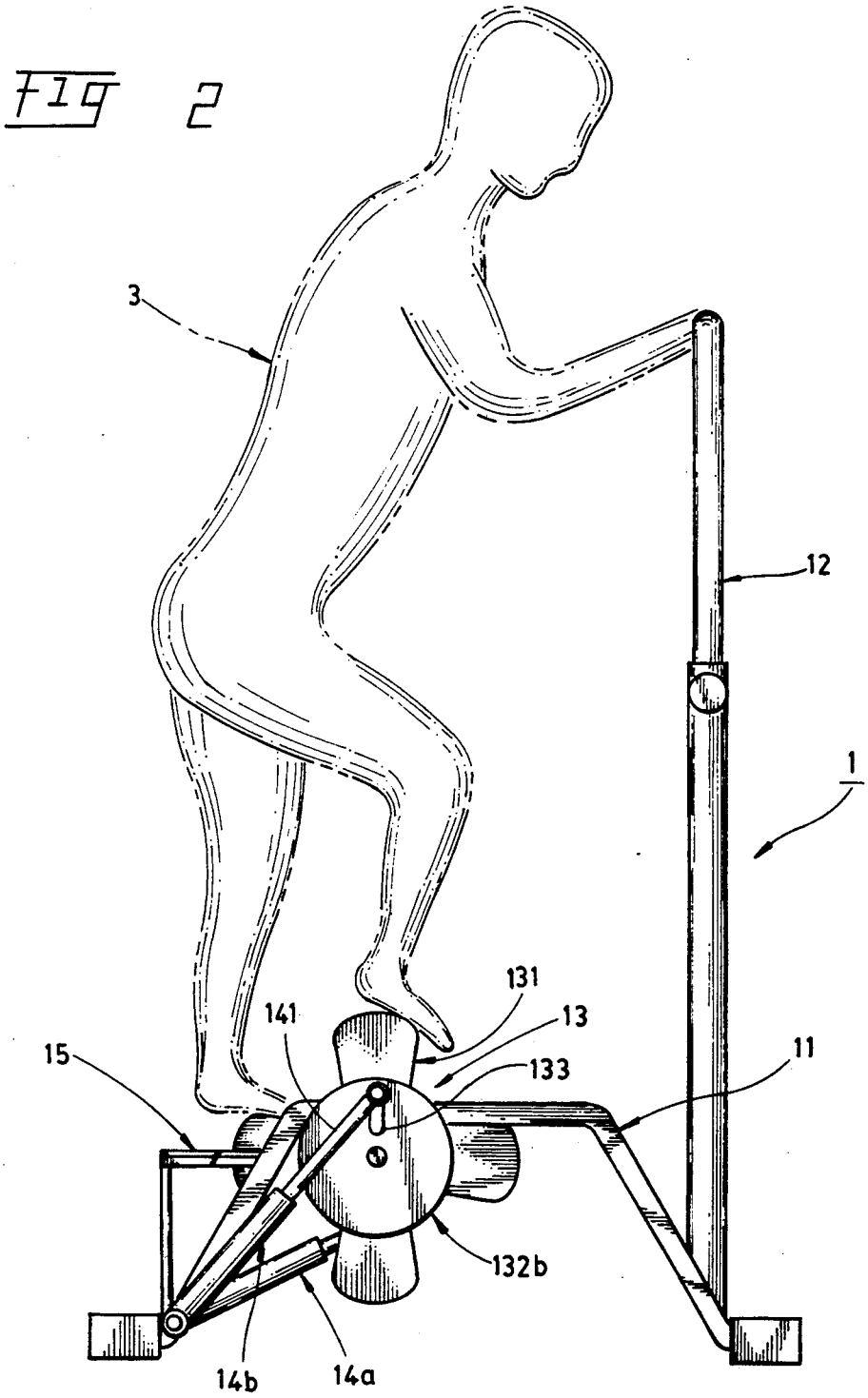
FIG. 2 is an optional view on the right side of the present invention during the healthful exercise.
Figure 3:
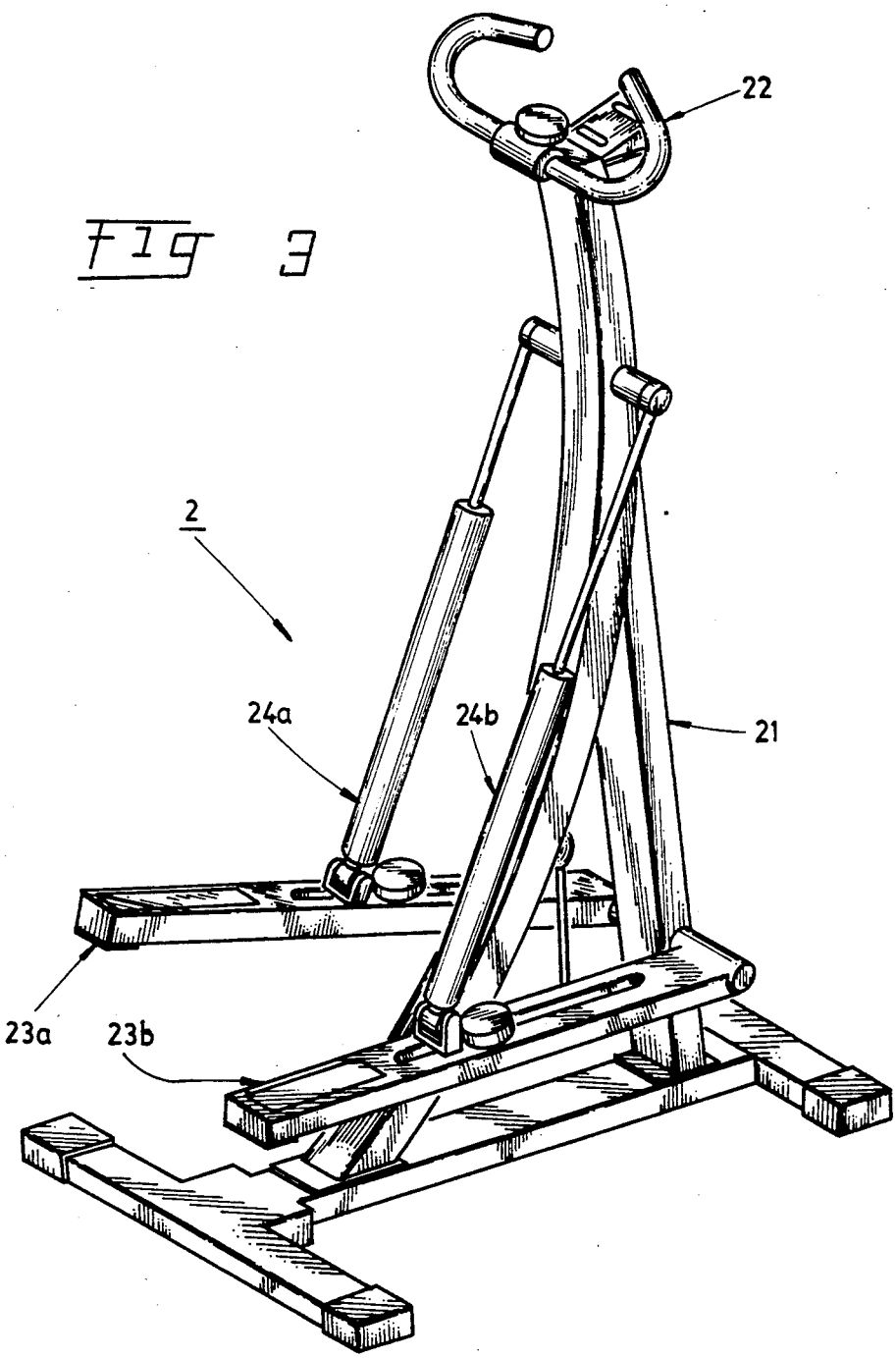
FIG. 3 is a prior art of the exercising machine.

When using the exercising machine 1 of the present invention for the healthful exercise, as shown in FIG. 2, the exerciser 3 may use his or her feet and by alternately treading up and down onto the fixed steps of the tread roller body 130, holding the handrail 12 with both hands, slightly bending his or her waist, and treading the tread roller 13 down and rearward with two both respectively, alternately and simultaneously in the manner of climbing a mountain so that the action of healthful exercise for whole body can be done and the healthful purpose of the whole body can be achieved.

I claim:

1. An exercising machine consisting essentially of:

a main frame having a substantially top horizontal surface area;

a hand rail attached to extend vertically from the frame;

a tread roller which includes a pivotal cylindrical roller body having two ends, wherein two pairs of pedal means are rigidly attached between said ends to said roller body, approximately in the center of said main frame along a horizontal axis, each pair of pedal means having a traverse horizontally positioned pivotal axis and one elongated foot engaging means having a foot engaging surface at each end of said elongated foot engaging means, said pair of pedal means being mounted on said roller body at a 90° to 135° offset from the other of said pair of pedal means;

a crank coupling means rigidly attached to each end of said roller body; and a resistance means comprising two dual action resistance cylinders, having two ends each wherein one end each of said resistance cylinders is pivotally secured to a forward side of the frame and a second end each of said resistance cylinders is pivotally connected to said crank coupling means so as to allow said roller body to be pivotally rotated in a clockwise or a counter clockwise rotation when in use.

2. The exercising machine of claim 1 wherein said crank coupling further includes a slot, for the purpose of adjustably connecting resistance cylinders to said crank coupling, thus allowing for the pivotal resistance of said pedal means to be adjusted as desired.

3. The exercising machine of claim 1 wherein said exercising machine comprises a step, provided on the front side of said main frame and a protective plate located on the rearward side of said main frame.

4. The exercising machine of claim 1 wherein the hand rail is height adjustable.

* * * * *